US006505761B2

(12) United States Patent
Amberg et al.

(10) Patent No.: US 6,505,761 B2
(45) Date of Patent: Jan. 14, 2003

(54) INJECTOR WITH A VACUUM PACKING DRUM

(75) Inventors: Guenther Amberg, Neuss (DE); Wolfgang Huber, Friedolfing (DE)

(73) Assignee: Ecolab GmbH & Co. OHG, Dusseldorf (DE)

( * ) Notice: Subject to any disclaimer, the term of this patent is extended or adjusted under 35 U.S.C. 154(b) by 0 days.

(21) Appl. No.: 09/529,624

(22) PCT Filed: Oct. 17, 1997

(86) PCT No.: PCT/EP97/05754

§ 371 (c)(1),
(2), (4) Date: Jul. 7, 2000

(87) PCT Pub. No.: WO99/20826

PCT Pub. Date: Apr. 29, 1999

(65) Prior Publication Data

US 2002/0056723 A1 May 16, 2002

(51) Int. Cl.[7] ..... B67D 5/42

(52) U.S. Cl. ..... 222/389; 222/95; 222/105; 222/205

(58) Field of Search ..... 222/95, 105, 152, 222/205, 386, 389, 416, 286, 260, 262, 263

(56) References Cited

U.S. PATENT DOCUMENTS

| | | | | | |
|---|---|---|---|---|---|
| 3,957,176 | A | * | 5/1976 | Marston | 222/185 |
| 5,076,471 | A | * | 12/1991 | Coleman | 222/105 |
| 5,339,989 | A | * | 8/1994 | Coleman | 222/105 |
| 5,887,752 | A | * | 3/1999 | Strother | 222/1 |
| 5,957,338 | A | * | 9/1999 | Lehmann | 222/184 |
| 6,149,034 | A | * | 11/2000 | Amberg et al. | 222/82 |

* cited by examiner

*Primary Examiner*—Henry C. Yuen
*Assistant Examiner*—Melvin Cartagena
(74) *Attorney, Agent, or Firm*—Andrew D. Sorensen; Ecolab Inc.

(57) ABSTRACT

The invention relates to an assembly for delivering a paste from a flexible supply packing drum to a dosing device. The packing drum is arranged in a dimensionally stable container and has a descending passageway for product guidance. The dosing device draws paste from the packing drum by use of a low pressure. In addition, a follower plate is arranged for positioning on the top of the flexible supply packing drum. An opening is provided in the bottom of the container. The container is sealed against the dosing device, and the follower plate is sealed against and moveable within the container. A low pressure is applied between the container and the flexible supply packing drum for assisting the transfer of paste into the dosing device.

4 Claims, 1 Drawing Sheet

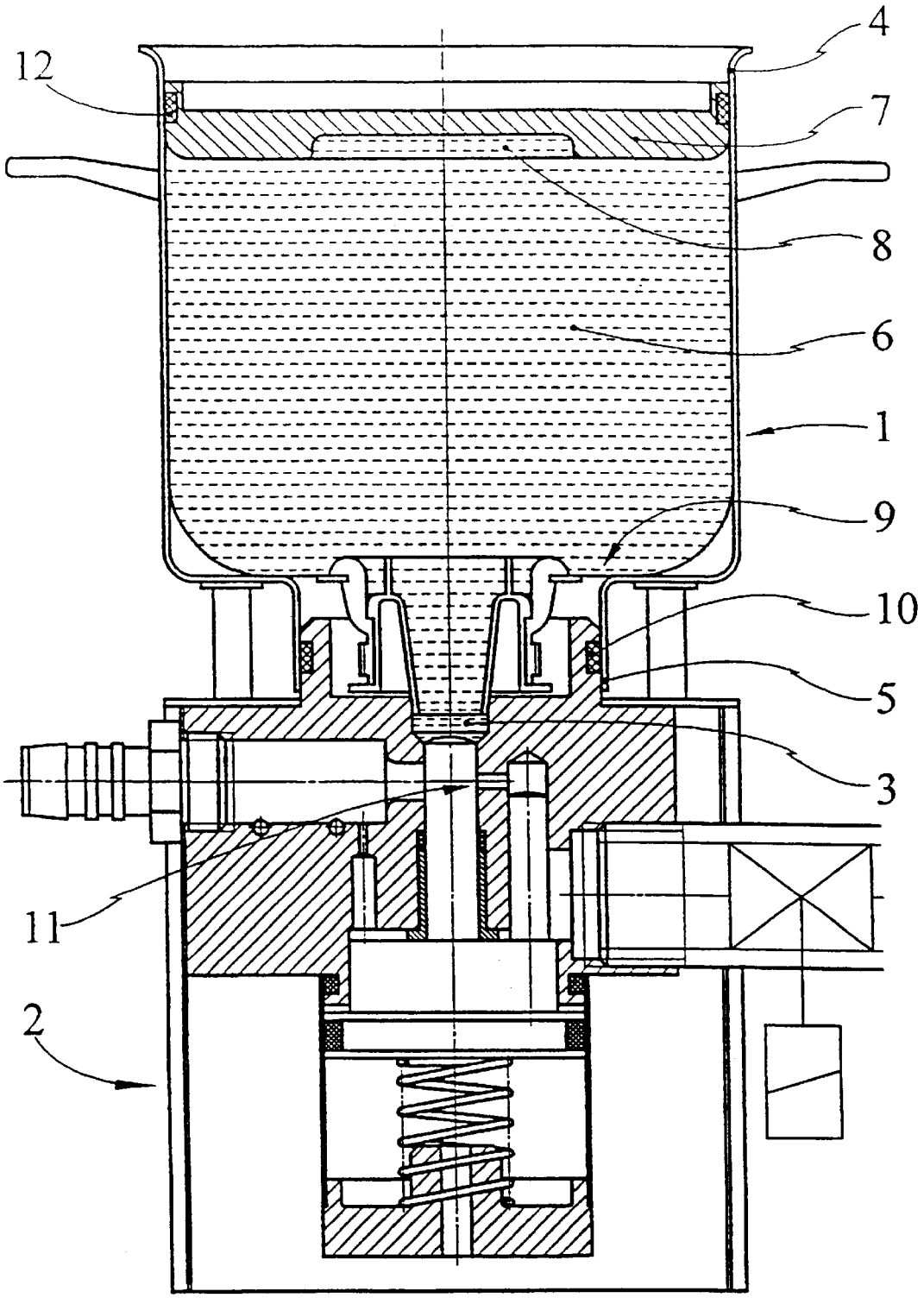
4
12
7
8
6
1
9
10
5
3
11
2

INJECTOR WITH A VACUUM PACKING DRUM

BACKGROUND

1. Field of the Invention:

This invention relates to generally to dispensers for paste-like products, and more specifically an arrangement for delivering and guiding a paste from a flexible storage container accommodated in a dimensionally stable container ("pot") downwards into a dispenser operating by reduced pressure.

2. Discussion of the Related Art:

Liquid to paste-form detergents are known in large numbers. They are generally formulated to meet domestic requirements, i.e. they are expected to be sufficiently liquid so that they can be poured out and measured/dosed without difficulty. Since, in addition, they are expected to be stable in storage over a relatively broad temperature range, the use of organic solvents and/or hydrotropic additives cannot normally be avoided. However, such additives do not contribute to the actual washing process, are comparatively expensive and, in addition, take up packaging space and transportation and storage capacity. The presence of flammable solvents is particularly troublesome and necessitates additional safety precautions on account of the relatively high consumption of detergents in laundries. Because of this, detergent concentrates of the type mentioned can only be used to a limited extent, if at all, in laundries.

Accordingly, powder-form detergents are mainly used in laundries. Since the exact dosing of powder-form detergents is problematical or labor-intensive, particularly in large and extensively automated laundries, the detergents are mostly stored and dispensed in predissolved form as stock liquors, i.e. a water-based concentrate is prepared and delivered to the individual points of consumption. However, the detergents typically used in laundries contain comparatively high levels of washing alkalis which are only soluble to a limited extent in cold water and, in addition, lead to so-called salting-out effects. They promote phase separation with the result that the organic components, more especially the nonionic surfactants and soaps, separate and cream up. Accordingly, the concentrates have to be diluted relatively heavily with water and, in addition, the stock liquors have to be constantly and intensively mixed and circulated to prevent individual components from being deposited in the feed lines to the points of consumption. Processes such as these require considerable investment in large mixing vessels and the associated static mixers and feeders and also a constant supply of energy for the heating and circulation of the stock liquors.

A detergent which meets these requirements is proposed in EP 0 295 525. This detergent is a paste which imposes particular demands on handling for the purpose of dosing and mixing with water as solvent. Detergent pastes such as these are transported and stored in large containers. It is proposed to place this storage container in a removal pot above the dispenser and to guide the paste downwards. In cases where a flexible container is used, it is proposed to place a follower plate on the container in the pot, this follower plate applying pressure to the storage container in order to ensure substantial emptying thereof. A corresponding arrangement is described in the specification.

It has been found that the follower plate has to be made very heavy to ensure uniform lowering and substantial emptying of the storage container. However, the disadvantage of this is that such heavy weights are difficult to handle so that the risk of errors in operation is increased. In addition, an overall very stable and hence expensive construction is required for the arrangement.

SUMMARY OF THE INVENTION

The technical problem addressed by the present invention is to further develop the known arrangement for a paste dispenser in such a way that the storage container is safely and substantially completely emptied by simple means. The solution to this problem provides in one embodiment of the invention that the pot is sealed off from the dispenser, the follower plate is sealed off from the pot and is movable therein; and a reduced pressure is applied between the pot and the flexible storage container.

The effect of this embodiment of the invention is that, without significant outlay and with simple means, atmospheric pressure is applied to the follower plate through the reduced pressure or suction applied to flexible storage container, so that the follower plate applies a pressure to the flexible storage container so uniformly that the follower plate is uniformly lowered to ultimately provide substantially complete emptying of the pot. The uniform lowering of the follower plate is advantageously be enhanced by the relative large width or height of its edges to prevent tilting in this way. If the space between the pot and the flexible storage container is connected to the suction side of the injector, the reduced pressure can be generated without any need for additional means.

BRIEF DESCRIPTION OF THE DRAWING

The above-mentioned advantages and other advantages are illustrated by the following description of an embodiment which is shown in the accompanying drawing. The drawing is a partial cross sectional view of the illustrated embodiment.

DETAILED DESCRIPTION OF THE INVENTION

Inserted into the pot 4 is a flexible storage container 6 filled with the paste to be dispensed. Arranged on the flexible container 6 is a follower plate 7 which bears tightly against the inner wall of the pot 4. Additional sealing elements 12 are provided to support the sealing effect. The follower plate 7 is movable in the pot 4. To ensure that it does not tilt during its movement, the edges of the follower plate 7 are formed over almost twice its axially directed height or maximum interior thickness. A central opening 8 is provided in the bottom of the follower plate 7. The effect of this is that, when the follower plate 7 descends substantially completely to the bottom of the pot 4, the circular periphery of the follower plate can descend as close to the bottom as possible, those parts of the neck of the container 6 which project into the pot 4 being accommodated in the opening 8.

If the space between the pot 4 and the flexible container 6 is evacuated, a reduced pressure is established with the result that the follower plate 7 is pressed by the atmospheric pressure onto the flexible container 6. As the container 6 continues to empty, the follower plate 7 descends further and is prevented from tilting by the relative wide width or height of its edges. The reduced pressure can be generated by a special source. However, it is of particular advantage if the injector present in any case in the dispenser 2 is used for this purpose. This injector—which operates in the manner of a water jet pump—is always brought into operation when paste is to be removed under suction from the container 6 and dispensed. If a connecting passage is provided between the suction side 11 of the injector and the space between the pot 4 and the container 6, the reduced pressure may also be used to evacuate that space.

In an arrangement of the illustrated embodiment, reduced pressure is used for two different functions. First, the paste is taken up and delivered by the reduced pressure on the suction side 11 of the injector through the pressure-tight connection between the entrance 3 to the dispenser 2 and the paste in the flexible storage container 6. Secondly, a reduced pressure is used between the flexible container 6 and the pot 4 to allow atmospheric overpressure to act on the follower plate 7 so that it descends uniformly. In one particular embodiment, the reduced pressure for both functions can be provided by one source, namely by the reduced pressure generated on the suction side 11 of the injector. Since the dispenser 2 is sealed off from the neck 5 of the pot 4 by the sealing elements 10, and the pot 4 is sealed off from the surrounding environment by the sealing elements 12, the space between the pot 4 and the flexible container 6 can also be connected to the reduced pressure of the suction side 11 of the injector by not inserting the passage of the neck insert of the container 6 into the entrance 3 in pressure-tight manner.

What is claimed is:

1. An arrangement for delivering a paste from a flexible storage container into a dispenser operating by reduced pressure, the arrangement comprising:

the flexible storage container, a dimensionally stable pot, the dispenser, a follower plate, a dispenser neck seal, and a follower plate seal;

the flexible storage container being surmounted by the follower plate, which applies pressure to the flexible storage container;

the base of the pot defining an opening; the opening and the pot being sealed off from ambient air by the dispenser neck seal;

the follower plate being movable along a longitudinal axis of the pot, the follower plate seal extending along the peripheral edge of the follower plate;

the pot and the flexible container defining between them a space; the follower plate seal being adapted and configured to seal the space from ambient air;

the space being in fluid communication with the reduced pressure by a gap between a neck of the container and an entrance of the dispenser.

2. An arrangement as claimed in claim 1, wherein the follower plate is unable to tilt.

3. An arrangement as claimed in claim 1, wherein the reduced pressure is provided by connecting the space between the pot and the flexible storage container to the suction side of an injector.

4. An arrangement as claimed in claim 2, wherein the reduced pressure is provided by connecting the space between the pot and the flexible storage container to the suction side of an injector.

* * * * *